US006447142B1

(12) United States Patent
Weir

(10) Patent No.: US 6,447,142 B1
(45) Date of Patent: Sep. 10, 2002

(54) PURSE WITH LIGHT SYSTEM

(76) Inventor: Karen L. Weir, 4599 Sandpiper Cove, College Station, TX (US) 77845

( * ) Notice: Subject to any disclaimer, the term of this patent is extended or adjusted under 35 U.S.C. 154(b) by 0 days.

(21) Appl. No.: 09/631,167

(22) Filed: Aug. 3, 2000

(51) Int. Cl.[7] ..... A45C 15/06

(52) U.S. Cl. ..... 362/156; 362/154; 362/577; 362/253; 150/100; 150/106

(58) Field of Search ..... 362/156, 154, 362/155, 158, 157, 551, 570, 577, 253; 150/100, 106

(56) References Cited

U.S. PATENT DOCUMENTS 5,444,605 A * 8/1995 Rivera ..... 362/156
5,709,448 A * 1/1998 Jennings et al. ..... 362/32

* cited by examiner

*Primary Examiner*—Stephen Husar
*Assistant Examiner*—Bertrand Zeade
(74) *Attorney, Agent, or Firm*—Joseph N. Breaux

(57) ABSTRACT

A purse with a built in light system. The light system is activated by a switch that turns the light on when the purse is opening and turns the light off when the purse is closed. The light is transmitted from a light source into an item holding chamber within the purse liner through a fiber optic cable.

1 Claim, 2 Drawing Sheets

PURSE WITH LIGHT SYSTEM

TECHNICAL FIELD

The present invention relates to purses and more particularly to a purse with a light system that includes a purse outer structure including an opening edge forming a purse access opening into an interior chamber of the purse outer structure when in an open position; a purse liner member attached to the interior of the purse outer structure to form an item holding chamber within the interior chamber of the purse outer structure that is sealable when the frame members are forced together into the closed position; and a light system including a battery power pack secured to the interior of the purse other structure between the purse outer structures and the purse liner member, a light assembly positioned to emit light into the item holding chamber of the purse liner member and in connection with the battery power pack through an on/off control switch mechanically connected to the opening edge such that the on/off control switch is in the "on" position when the purse access opening is in the open position and in the "off" position when the purse access opening is closed; the on/off control switch being a proximity switch with an activation plunger that is pushed into the "off" position when the opening edge is in the closed position and that springs outward into the "on" position when the opening edge is pivoted into the open position; the light assembly including a light source such as a light bulb or light emitting diode. The purse with light system optionally including a light conduit in the form of a length of fiber optic cable in connection between the light source and the item holding chamber of the purse liner.

BACKGROUND ART

Purses provide an effective mechanism for carrying a large variety of items. Although purses are effective for carrying items, it can be difficult to find a particular item within a purse when a large number of items are present because the interior of the purse is typically dark. It would be desirable, therefore, to have a purse with a built in light system that automatically illuminated the interior of the purse each time the purse was opened.

GENERAL SUMMARY DISCUSSION OF INVENTION

It is thus an object of the invention to provide a purse with light system that includes a purse outer structure including an opening edge forming a purse access opening into an interior chamber of the purse outer structure when in an open position; a purse liner member attached to the interior of the purse outer structure to form an item holding chamber within the interior chamber of the purse outer structure that is sealable when the frame members are forced together into the closed position; and a light system including a battery power pack secured to the interior of the purse other structure between the purse outer structures and the purse liner member, a light assembly positioned to emit light into the item holding chamber of the purse liner member and in connection with the battery power pack through an on/off control switch mechanically connected to the opening edge such that the on/off control switch is in the "on" position when the purse access opening is in the open position and in the "off" position when the purse access opening is closed; the on/off control switch being a proximity switch with an activation plunger that is pushed into the "off" position when the opening edge is in the closed position and that springs outward into the "on" position when the opening edge is pivoted into the open position; the light assembly including a light source such as a light bulb or light emitting diode. The purse with light system optionally including a light conduit in the form of a length of fiber optic cable in connection between the light source and the item holding chamber of the purse liner.

Accordingly, a purse with light system is provided. The purse with light system includes a purse outer structure including an opening edge forming a purse access opening into an interior chamber of the purse outer structure when in an open position; a purse liner member attached to the interior of the purse outer structure to form an item holding chamber within the interior chamber of the purse outer structure that is sealable when the frame members are forced together into the closed position; and a light system including a battery power pack secured to the interior of the purse other structure between the purse outer structures and the purse liner member, a light assembly positioned to emit light into the item holding chamber of the purse liner member and in connection with the battery power pack through an on/off control switch mechanically connected to the opening edge such that the on/off control switch is in the "on" position when the purse access opening is in the open position and in the "off" position when the purse access opening is closed; the on/off control switch being a proximity switch with an activation plunger that is pushed into the "off" position when the opening edge is in the closed position and that springs outward into the "on" position when the opening edge is pivoted into the open position; the light assembly including a light source such as a light bulb or light emitting diode. The purse with light system optionally including a light conduit in the form of a length of fiber optic cable in connection between the light source and the item holding chamber of the purse liner.

BRIEF DESCRIPTION OF DRAWINGS

For a further understanding of the nature and objects of the present invention, reference should be made to the following detailed description, taken in conjunction with the accompanying drawings, in which like elements are given the same or analogot reference numbers and wherein.

EXEMPLARY MODE FOR CARRYING OUT THE INVENTION

Figure 1:
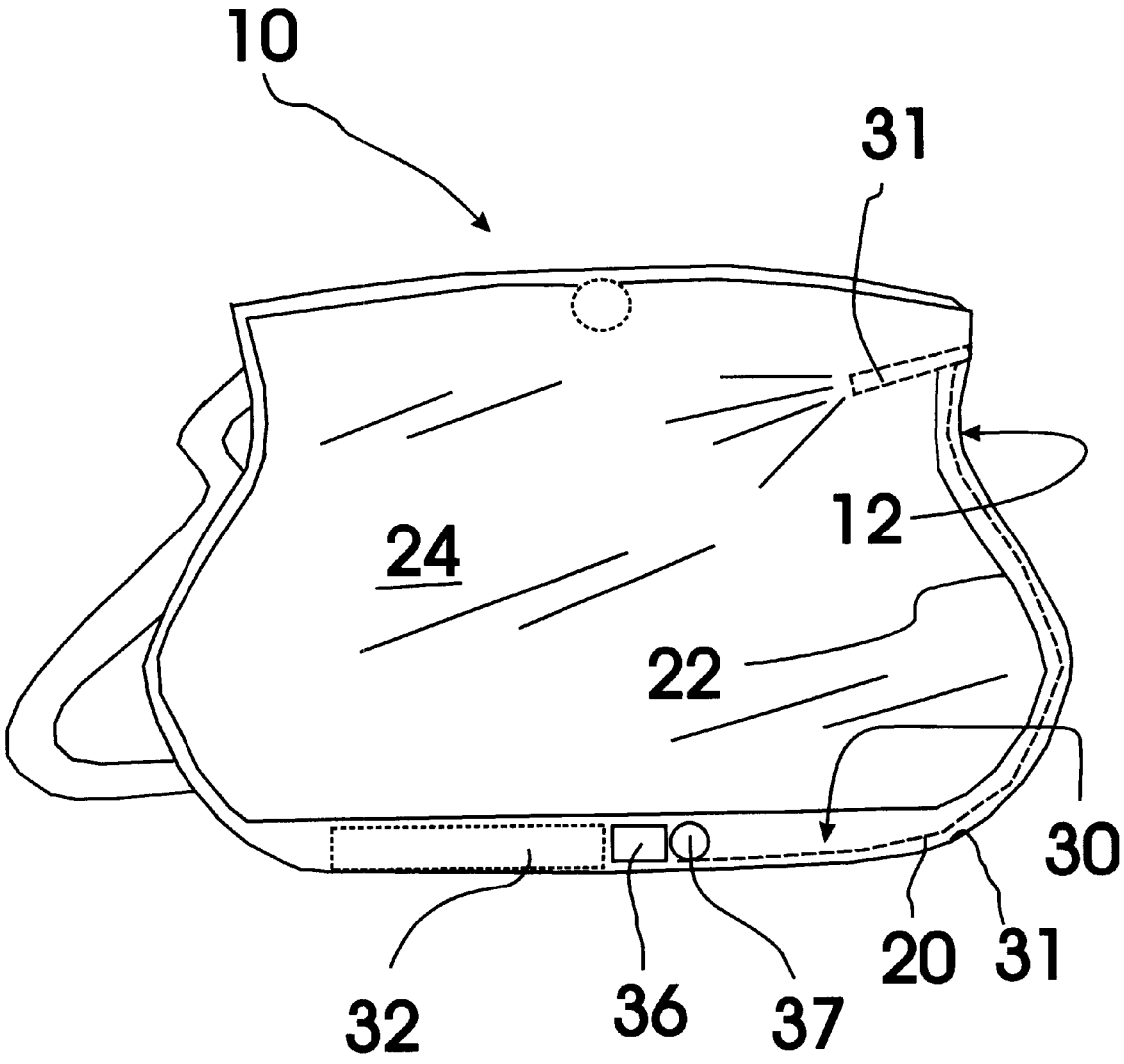
FIG. 1 is a partial cut-away view of an exemplary embodiment of the purse with light system of the present invention.
Figure 2:
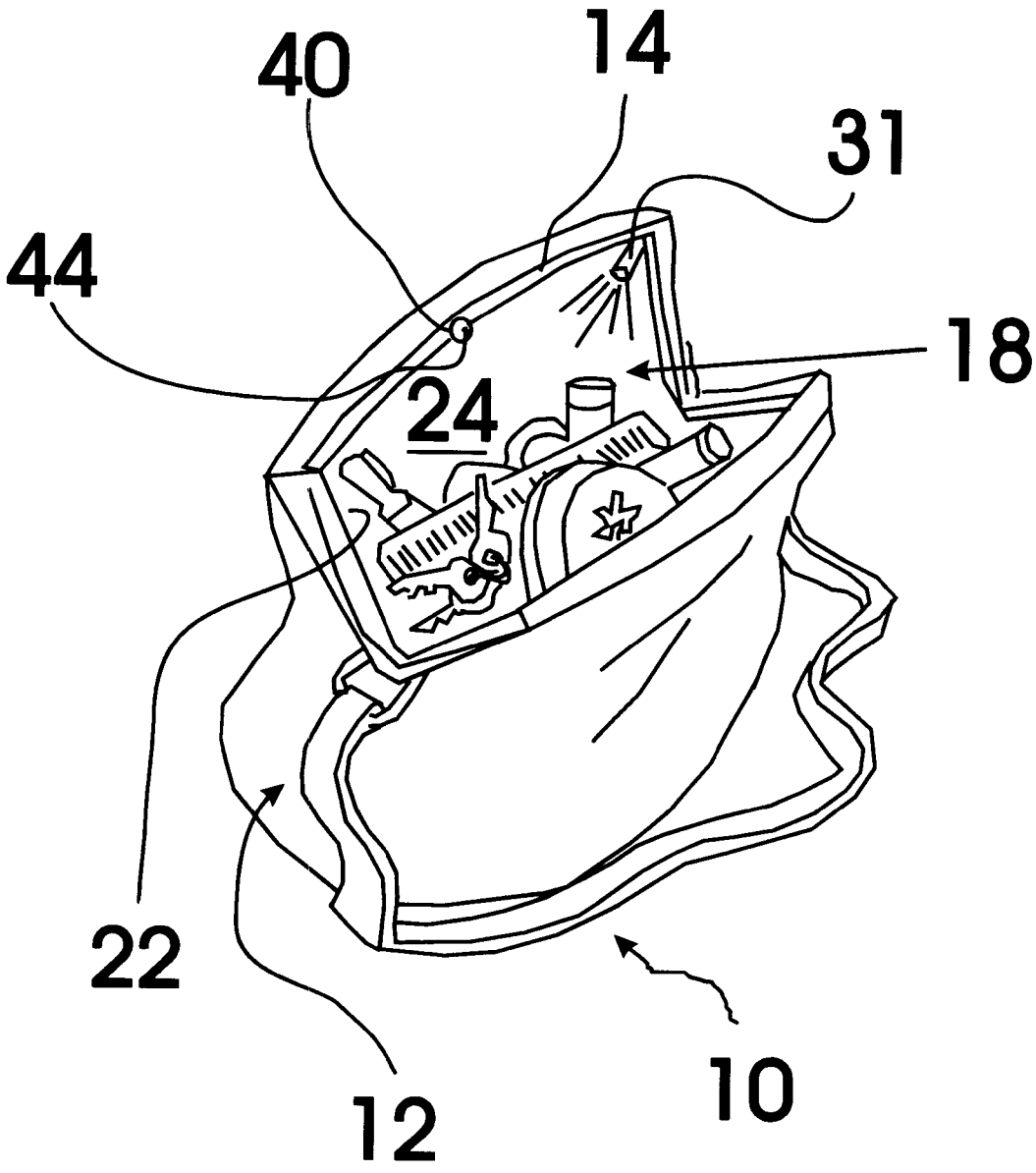
FIG. 2 is a perspective view showing the opening edge in the open position, the activation plunger extending outward into the "on" position, and the light illuminating the item holding chamber from the end of the fiber optic cable.

FIGS. 1 and 2 show various aspects of an exemplary embodiment of the purse with light system of the present invention generally designated 10. Purse with light system 10 includes a purse outer structure, generally designated 12, including opening edge 14 forming a purse access opening 18 into an interior chamber 20 of purse outer structure 12 when opening edge 14 is in an open position; a purse liner member 22 attached to the interior of purse outer structure 12 to form an item holding chamber 24 within interior chamber 20 of purse outer structure 12 that is sealable when access opening 14 is in the closed position; and a light system, generally designated 30 including a battery power pack 32 secured to the interior of purse other structure 12 between purse outer structure 12 and the purse liner member 22, a light assembly 36 having a light bulb 37 positioned to emit light into item holding chamber 24 of purse liner member 22 through a length of fiber optic cable 31 connected between light bulb 37 and the interior of item holding chamber. Light bulb 37 is in connection with battery power pack 32 through an on/off proximity control switch 40 mechanically connected to opening edge 14 such that on/off control switch 40 is in the "on" position when opening edge 14 is in the open position and in the "off" position when opening edge 14 is closed. On/off proximity control switch 40 is a spring loaded switch with an activation plunger 44 that is pushed into the "off" position when opening edge 14 is in the closed position and that springs outward into the "on" position when opening edge 14 is in the open position.

It can be seen from the preceding description that a purse with light system has been provided.

It is noted that the embodiment of the purse with light system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A purse with light system comprising:

a purse outer structure including an opening edge forming a purse access opening into an interior chamber of the purse outer structure when in an open position;

a purse liner member attached to the interior of the purse outer structure to form an item holding chamber within the interior chamber of the purse outer structure that is sealable when the frame members are forced together into the closed position; and a light system including a light source and a battery power pack secured to the interior of the purse outer structure between the purse outer structure and the purse liner member, a light assembly positioned to emit light into the item holding chamber of the purse liner member through a light conduit in the form of a length of fiber optic cable in connection between the light source and the item holding chamber of the purse liner; the light source being in connection with the battery power pack through an on/off control switch mechanically connected to the opening edge such that the on/off control switch is in the "on" position when the purse access opening is in the open position and in the "off" position when the purse access opening is closed; the on/off control switch being a proximity switch with an activation plunger that is pushed into the "off" position when the opening edge is in the closed position and that springs outward into the "on" position when the opening edge is pivoted into the open position.

* * * * *